US005398919A

United States Patent [19]

Suter

[11] Patent Number: 5,398,919

[45] Date of Patent: Mar. 21, 1995

[54] APPARATUS FOR COLLECTING AND TRANSPORTING GROUPS OF PAPER SHEETS

[76] Inventor: Walter Suter, Ringlikerstrasse 39, CH-8142 Uitikon-Waldegg, Switzerland

[21] Appl. No.: 937,994

[22] Filed: Aug. 31, 1992

Related U.S. Application Data

[63] Continuation-in-part of Ser. No. 819,602, Jan. 9, 1992, abandoned, which is a continuation of Ser. No. 488,887, Mar. 6, 1990, abandoned.

[30] Foreign Application Priority Data

Mar. 6, 1989 [CH] Switzerland ..... 822/89

[51] Int. Cl.[6] ..... B65H 39/10

[52] U.S. Cl. ..... 270/58; 271/302; 271/184; 271/202

[58] Field of Search ..... 270/52.5, 58; 271/306, 271/176, 184, 189, 190, 191, 198, 199, 202, 207, 214, 215, 279, 302

[56] References Cited

U.S. PATENT DOCUMENTS

| | | | |
|---|---|---|---|
| 2,670,955 | 3/1954 | Strecker | 271/202 |
| 3,070,365 | 12/1962 | Lohrmann | 270/52 |
| 3,356,361 | 12/1967 | Geisler et al. | 271/198 X |
| 4,034,973 | 7/1977 | Hams | 270/58 X |
| 4,118,022 | 10/1978 | Rayfield et al. | 270/52.5 |
| 4,273,319 | 6/1981 | Stocker | 270/58 X |
| 4,466,603 | 8/1984 | Schnell | 270/58 |
| 4,572,497 | 2/1986 | Dreschel et al. | 270/58 |
| 4,593,893 | 6/1986 | Suter | 270/52.5 |
| 4,641,555 | 2/1987 | Johnson et al. | 270/58 X |
| 5,288,063 | 2/1994 | Lunt | 270/58 |
| 5,326,093 | 7/1994 | Sollitt | 271/306 |
| 5,346,195 | 9/1994 | Heimann et al. | 270/52.5 |

*Primary Examiner*—Edward K. Look
*Assistant Examiner*—John Ryznic
*Attorney, Agent, or Firm*—Jay H. Maioli

[57] ABSTRACT

Paper sheets are fed in a first direction until the sheets abut a stop plate and fall downwardly to form a stack. A sensor detects a sign on a last sheet in a group and when that sheet falls on the stack, the entire group of sheets is transported away in a first direction generally perpendicular to the feed direction or a second direction opposite to the first direction. To aid in the transportation away, two pairs of drive rollers are mounted on either side of the transport which grasp the stack of sheets and transports them away from the stacking area.

8 Claims, 1 Drawing Sheet

APPARATUS FOR COLLECTING AND TRANSPORTING GROUPS OF PAPER SHEETS

This application is a continuation-in-part of Ser. No. 07/819,602, filed Jan. 09, 1992, now abandoned; which is a continuation of Ser. No. 07/488,887, filed Mar. 6, 1990, now abandoned.

PRIOR ART

From U.S. Pat. No. 4,593,893 it is known to cut a continuous form web into individual paper sheets and to collect the sheets in groups in several sorting trays. Optical sensors detect marks on the sheets to direct them to the appropriate tray. The collected groups are then taken from the trays.

From U.S. Pat. No. 4,466,603 it is known to form stacks of sheets on a transverse conveyor and to transport them away stepwise in a direction transverse to the initial transport direction.

SUMMARY OF THE INVENTION

The object of the present invention is to efficiently form accurately aligned groups of sheets and to transport the formed groups away to a further processing station, e.g. to a folding machine.

The apparatus according to the present invention comprises:

a) a feeder for feeding the sheets of paper in a first plane in a first direction with a leading edge of the sheets extending perpendicular to the first direction;
b) a stop against which the leading edge abuts and which stops the sheets;
c) a support on a second plane below the first plane, on which support a group of sheets is formed;
d) a conveyor adapted for movement parallel to the second plane in a second direction and in a reverse direction perpendicular to the first direction;
e) a reversible motor for moving said conveyor in the second direction and the reverse direction;
f) two pushers mounted on the conveyor, spaced apart in the second direction and projecting above the second plane, wherein the group of sheets is formed between the two pushers; and
g) a drive on either side of the support in the second and reverse direction for grasping and further transporting the group of sheets pushed by the two pushers in one of the second and reverse directions.

The apparatus further comprises a sensor for sensing a sign attached to a last sheet of a group to be formed and a controller connected to the motor and the sensor for activating the motor in response to a signal of the sensor.

When the sensor senses the sign on the last sheet of the group the pushers are actuated as soon as that last sheet has dropped on the collected group of sheets. The sheets of the group were previously aligned along their leading edge by the stopper. When the pusher accelerates the group in the second direction the sheets of the group automatically align in their other direction by abutment on the pusher. The groups are therefore efficiently formed and transported away accurately aligned depending on the sensed sign in the second direction e.g. to a folding and enveloping machine or in the reverse direction e.g. to a manual handling station, e.g. for oversea mail or for thicker groups that cannot be handled by the folding machine.

BRIEF DESCRIPTION OF THE DRAWINGS

An embodiment of the invention is hereinafter described with reference to the drawings, wherein.

DETAILED DESCRIPTION OF THE DRAWINGS

Figures 1, 2, 3:
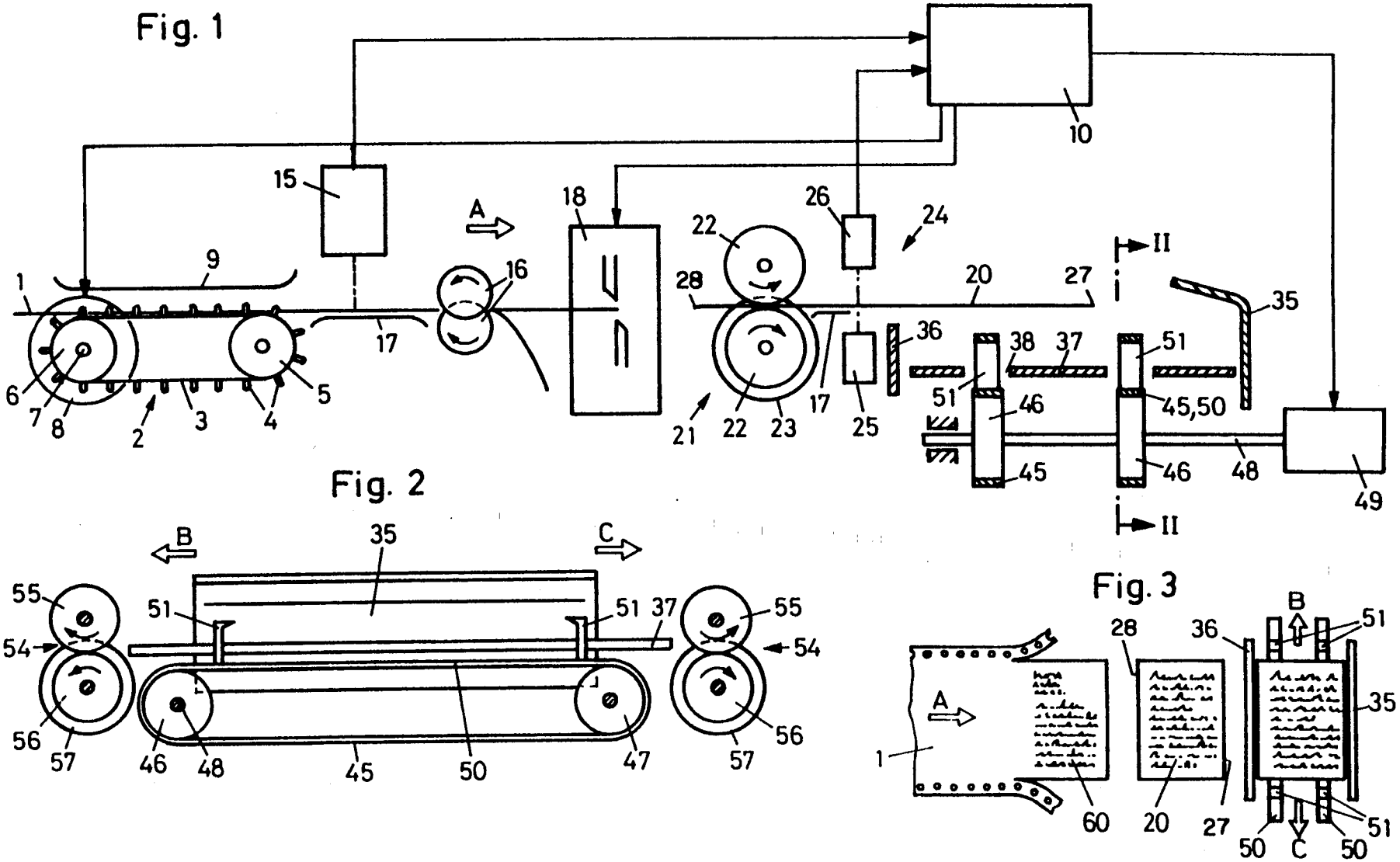
FIG. 1 shows a schematic side elevation of an apparatus according to the invention.
FIG. 2 shows a sectional view along the lines II—II in FIG. 1.
FIG. 3 shows a schematic partial top view of the paper handling with only a few elements of the apparatus shown.

Turning now to FIG. 1, a continuous web 1 of printed paper with perforated edge portions is pulled off from a zig-zag-folded stack (not shown) or directly from a laser printer by a first feeder 2 in an advance direction A. The feeder 2 consists of two parallel, spaced apart toothed belts 3 with upstanding teeth or pins 4. Each belt 3 runs on two gear wheels 5, 6. A common shaft 7 of the wheels 6 of the two belts 3 is driven by a motor 8, e.g. a step motor, which is controlled by a controller 10. The perforated edge portions of the web 1 are engaged by the pins 4. A slotted plate 9 (shown spaced for better presentation) holds them engaged. This type of feeder 2 is known in the art. It allows for an accurate feeding in a given length at a time.

Downstream of the feeder 2 the web 1 passes a sensor 15, e.g. a bar code reader, which senses special signs printed on the web 1 for controlling the apparatus. The signs may be bar codes, and they may be printed on the perforated edge portions which are cut away from the web 1 downstream of the sensor 15 by two pairs of coacting, driven knife disks 16. The web 1 may be supported on its way through the apparatus by support plates 17.

A conventional cross cutter 18 is located downstream of the knife disks 16. The cutter 18 cuts the web 1 into individual sheets 20 of paper of a predetermined length. The cutter is controlled by the controller 10.

The cut sheets 20 are pulled away from the remaining web 1 by a second feeder 21 consisting of a pair of rollers 22. One of the rollers 22 is driven by a continuously running motor 23 via a friction clutch. Alternatively the motor 23 may be controlled by controller 10 so that it runs synchronous with the motor 8 until the cutter 18 is actuated. A second sensor 24 consisting of a light emitter 25 and a photo receiver 26 senses the trailing edge 27 of the passing sheet 20.

The sheet 20 is advanced in direction A by feeder 21 at relatively high speed towards a stationary stop plate 35 against which the leading edge 28 of the sheet 20 abuts. The sheet 20 then drops between stop 35 and a trailing edge stop plate 36 onto a horizontal support plate 37. Plate 37 has two longitudinal slots 38 and is situated below the common tangential plane of rollers 22 which defines the first plane of advance in direction A.

Two parallel endless toothed belts 45 are mounted on two pairs of gear wheels 46, 47 and are also shown in FIG. 2. The two wheels 46 are mounted on a common drive shaft 48 which is coupled to a servo motor 49. The upper reach 50 of the belts 45 is parallel to and below the plate 37. Two pushers 51 each are mounted spaced apart from one another on the upper reach 50. The pushers 51 extend through the slots 38 and project above the plate 37. The sheets 20 drop on the plate 37 between the pushers 51.

When a sign indicating that a last sheet of a group to be formed passes the sensor 15 the signal of that sensor is stored in controller 10. The sign may contain additional information on the direction in which the collected group of sheets is to be transported away. Upon the next advance of the web by the feeder 2 the sensor 24 is activated. When the cutter 18 cuts the advanced sheet 20 loose from the web, that sheet 20 is rapidly advanced towards the stop 35 and drops onto the collected group. The sensor 24 senses the trailing edge of sheet 20 and, with a short time delay allowing the sheet 20 to drop, the controller 10 starts the motor 49 in the direction that was previously entered in the controller.

The group is now pushed by the respective pushers 51 in the selected direction B or C perpendicular to direction A on the plate 37 towards one of two drive means 54 constituted each by a pair of drive rollers 55, 56. One of the rollers 56 of each pair is continuously driven by a respective motor 57.

In order to minimize the movement of the belts 45 for maximum speed of the apparatus it is advantageous to use a servo motor 49 with position feed back so that the neutral position shown in FIG. 2 can be accurately reached and the spacing between the pushers 51 need not be much larger than the length of the sheet 20. However, if speed is not critical the motor 49 may be a simple reversible motor under limit switch control.

FIG. 3 shows an application of the apparatus according to the present invention. In modern laser printers, the printing lines 60 can be selected to be parallel to the advance direction A. In this application the leading and trailing edges 27, 28 of the cut sheet 20, which are perpendicular to direction A and parallel to direction B and C, extend in the longer dimension of the sheets.

I claim:

1. An apparatus for collecting individual rectangular sheets of paper having a longer dimension and a shorter dimension, to form a group of sheets and for transporting said group of sheets, comprising:

a feeder for feeding said individual sheets in a first plane in a first direction with a leading edge of said sheets extending perpendicular to said first direction and with printed lines on said sheets oriented parallel to said first direction;

a stop against which said leading edge abuts and which stops a movement of said sheets;

a support on a second plane below said first plane, on which support said group is formed;

conveyor means movable parallel to said second plane in a second direction perpendicular to said first direction and in an opposite direction opposite said second direction;

reversible motor means for moving said conveyor means in said second direction and in said opposite direction;

pusher means mounted on said conveyor means, spaced apart in said second direction, and projecting above said second plane, wherein said group of sheets is formed between said pusher means, and a pair of drive means each mounted on either side of said support in said second direction and in said opposite direction for grasping and further transporting said group of sheets pushed by said pusher means in one of said second and said opposite directions.

2. The apparatus of claim 1, further comprising sensor means for sensing a sign attached to a sheet of said group of sheets to be formed and control means connected to said motor means and to said sensor means for activating said motor means in response to a signal of said sensor means.

3. The apparatus of claim 1, further comprising two pairs of wheels, one of said pairs of wheels being mounted on a common drive shaft connected to said motor means on one side of said support and another of said pairs of wheels being mounted parallel to said one pair on another side of said support opposite said one side, wherein said conveyor means is formed by two parallel endless toothed belts extending around said two pairs of wheels, a reach of each of said toothed belts extending parallel to said second plane, wherein said pusher means is formed by two pushers each attached to said toothed belts.

4. The apparatus of claim 3, wherein said toothed belts are arranged below said second plane, said reaches of said toothed belts being their upper reaches.

5. The apparatus of claim 1, wherein said motor means is a servo motor.

6. The apparatus of claim 1, wherein said leading edge of said sheets extends in the longer dimension of said sheets.

7. The apparatus of claim 1, wherein said stop comprises a first stop and further comprising a second stop for a trailing edge of said sheets provided below said first plane and spaced from said first stop.

8. The apparatus of claim 1, wherein each of said pair of drive means comprises a pair of drive rollers, one of said pairs of drive rollers being driven by a motor.

* * * * *